US007331797B1

(12) United States Patent
Ju

(10) Patent No.: US 7,331,797 B1
(45) Date of Patent: Feb. 19, 2008

(54) ELECTRICAL CONNECTOR AND A MANUFACTURING METHOD THEREOF

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/492,878

(22) Filed: Jul. 26, 2006

(51) Int. Cl.
*H01R 12/00* (2006.01)

(52) U.S. Cl. ..... 439/66; 439/886

(58) Field of Classification Search ..... 439/66, 439/91, 591, 886
See application file for complete search history.

(56) References Cited

U.S. PATENT DOCUMENTS 4,548,451 A * 10/1985 Benarr et al. ..... 439/85
5,299,939 A * 4/1994 Walker et al. ..... 439/74
5,495,395 A * 2/1996 Yoneda et al. ..... 361/765
6,279,227 B1 * 8/2001 Khandros et al. ..... 29/885
6,770,383 B2 * 8/2004 Tanaka et al. ..... 428/646
6,872,470 B2 * 3/2005 Minamikawa ..... 428/672
7,048,548 B2 * 5/2006 Mathieu et al. ..... 439/66
7,156,669 B2 * 1/2007 Asai et al. ..... 439/91
2005/0048308 A1 * 3/2005 Mucklich et al. ..... 428/614
2005/0124181 A1 * 6/2005 Brown et al. ..... 439/66
2005/0208786 A1 * 9/2005 Dittmann ..... 439/66
2006/0040519 A1 * 2/2006 Arai et al. ..... 439/66
2006/0281340 A1 * 12/2006 Umezawa et al. ..... 439/66

* cited by examiner

*Primary Examiner*—Gary Paumen
(74) *Attorney, Agent, or Firm*—Rosenberg, Klein & Lee

(57) ABSTRACT

A manufacturing method for an electrical connector is provided. The electrical connector includes a main portion and a plurality of supporting members that are connected with the main portion. The supporting members are applied with a plurality of metal layers thereon, respectively, which are formed by the following manufacturing steps. In the first step, a first metal layer is coated on the supporting members by a physical coating manner. In the second step, a second metal layer with high electric conductivity is applied on an outermost surface of the supporting members. Compared with the prior art, the present invention has a simple structure and is manufactured easily to reduce production costs, which enhances the effective contact of the electrical connector and the mating electronic elements.

10 Claims, 3 Drawing Sheets

ELECTRICAL CONNECTOR AND A MANUFACTURING METHOD THEREOF

BACKGROUND OF THE INVENTION

1. Field of the Invention

The present invention relates to an electrical connector and a manufacturing method thereof, and in particular to an electrical connector that has a plurality of supporting members for contacting elastically with mating electronic elements in an oscillating manner.

2. Description of Related Art

Today there are many common electrical connectors, which usually include an insulative housing and conductive terminals received in the insulative housing. The insulative housing is formed with a plurality of terminal grooves for receiving conductive terminals in the corresponding terminal grooves. Each of the conductive terminals has a fixing portion and a pair of conductive portions formed at two ends thereof. The conductive portions are respectively pressed and contacted by two mating electronic elements for electrically connecting the two mating electronic elements. However, such kinds of conductive terminals usually have a complex shape, so that they are expensive to manufacture. Moreover, a great direct pressing force is placed upon the conductive terminals when connecting with the mating electronic elements, so that they are deformed easily after being pressed many times. Deformation makes the electrical connector unable to contact the mating electronic elements effectively and affects the performance therefore.

Accordingly, the present invention aims to propose an electrical connector that solves the above-mentioned problems in the prior art.

SUMMARY OF THE INVENTION

An object of the present invention is to provide a manufacturing method for an electrical connector, which allows the electrical connector to be able to contact two mating electronic elements and also reduces the cost of the electrical connector.

Another object of the present invention is to provide an electrical connector, which can contact two mating electronic elements effectively and also reduces the manufacturing cost thereof.

To achieve the first object described above, the present invention provides a manufacturing method for an electrical connector, which includes a manufacturing method for an electrical connector including the following steps. A main portion and a plurality of supporting members connected with the main portion are provided. A plurality of metal layers are applied on the supporting members, respectively. The metal layers are formed by the following manufacturing steps. In the first step, a first metal layer is coated on the supporting members by a physical coating manner, respectively. In the second step, a second metal layer with high electric conductivity is applied on an outermost surface of the supporting members, respectively.

To achieve the second object described above, the present invention provides an electrical connector, which includes a main portion and a plurality of supporting members that are respectively formed with a plurality of metal layers for achieving an electrically connection.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention can be fully understood from the following detailed description and preferred embodiment with reference to the accompanying drawings, in which.

DETAILED DESCRIPTION OF THE PREFERRED EMBODIMENTS

Figure 1:
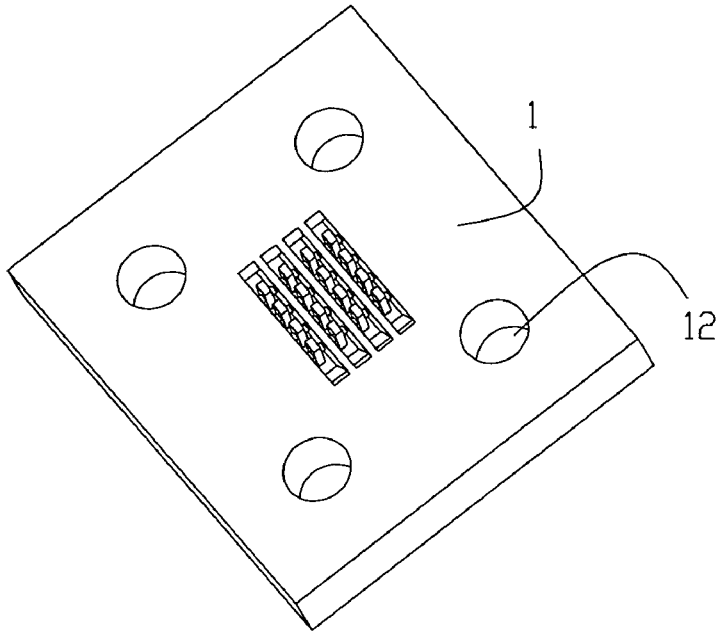
FIG. 1 is a perspective view of an electrical connector according to the present invention.
Figure 2:
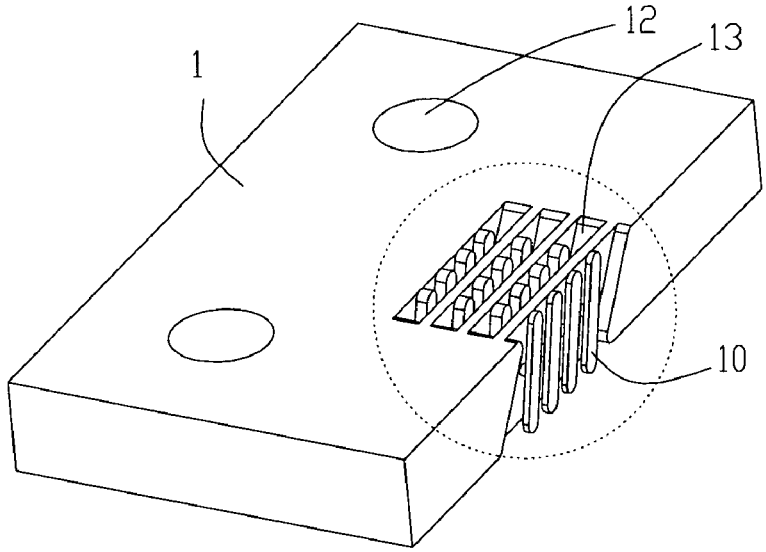
FIG. 2 is a perspective cross-sectional view of FIG. 1.
Figure 3:
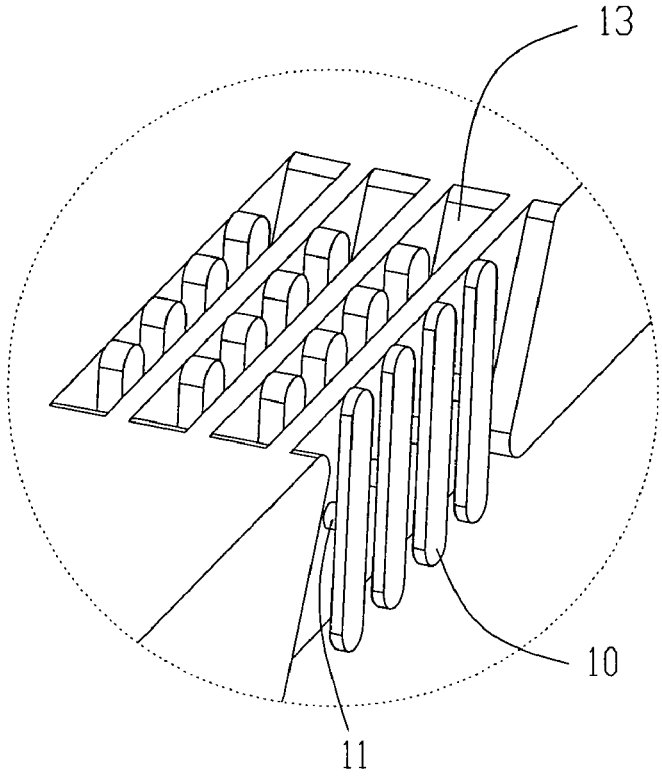
FIG. 3 is a magnified perspective view of FIG. 2.
Figure 4:
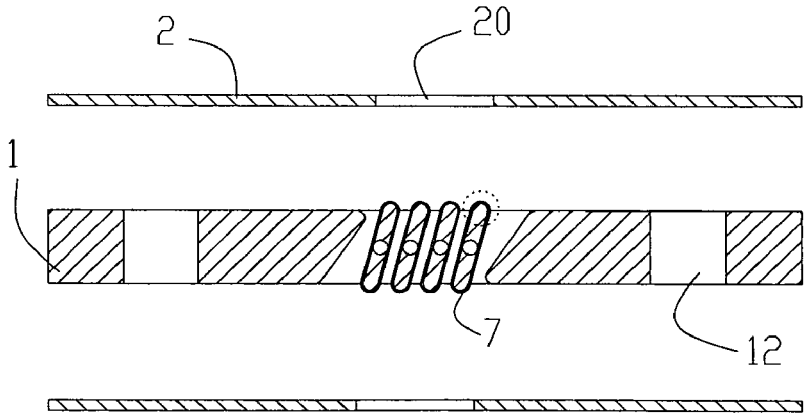
FIG. 4 is a perspective view of an electrical connector and a shielding member according to the present invention.
Figure 5:
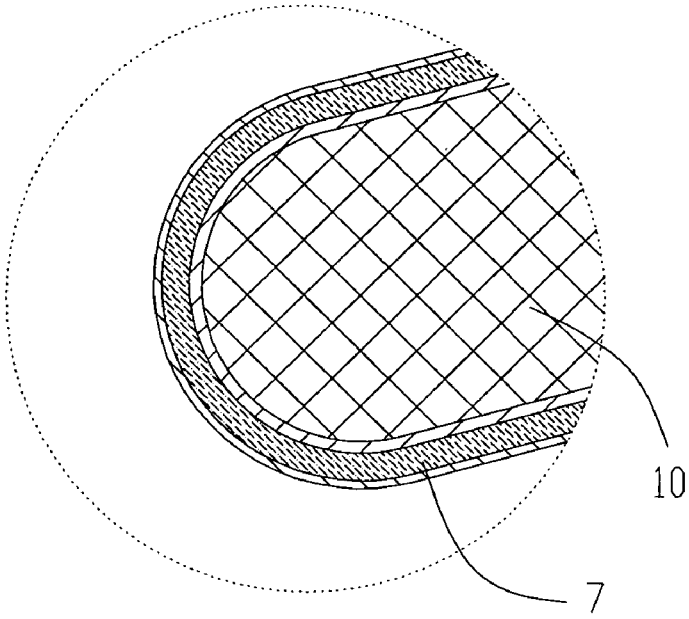
FIG. 5 is a magnified perspective view of FIG. 4.

The following detailed description is of the best presently contemplated modes of carrying out the invention.

Reference is made to FIGS. 1-6. The present invention provides an electrical connector, which includes a main portion 1 and a plurality of supporting members 10 received in the main portions 1. Each of the supporting members 10 has many metal layers 7 that are applied on a peripheral surface thereof.

The manufacturing method of the present invention includes the following steps. In first step, a first metal layer is plated on the supporting members 10 via a physical coating manner. The first metal layer can be cladding copper, or other metal of course. In a second step, at least one metal layer, which is thicker than the first metal layer, is further plated on a surface of the first metal layer of the supporting members 10 via an electroplating manner or other coating manner. The thicker metal layer in this embodiment only has one layer, but there can be a number of thicker metal layers. Moreover, the material of this thicker metal layer can be copper or nickel or any other metal. In a third step, a metal layer with high electric conductivity, such as gold or other material, is coated on an outermost surface of the supporting members 10 via an electroplating manner or other coating manner. The electroplating manner is a preferred embodiment in the present invention, because it increases wear-resistance and corrosion resistance, especially for frequent contact with the mating electronic elements.

A shielding member 2 is utilized to shield the electrical connector during the aforementioned manufacturing steps for coating on the selected area. Therefore, the metal layers 7 need only be coated on the required area. The shielding member 2 forms a through hole 20. The through hole 20 allows the metal material to be coated on the required area of the electrical connector therethrough. The main portion 1 forms a receiving space 13, and the supporting member 10 is received in the receiving space 13 of the main portion 1 for contacting the mating electronic elements. The electronic elements are a chip module 4 and a mating PCB 5 as shown in FIG. 6.

Figure 6:
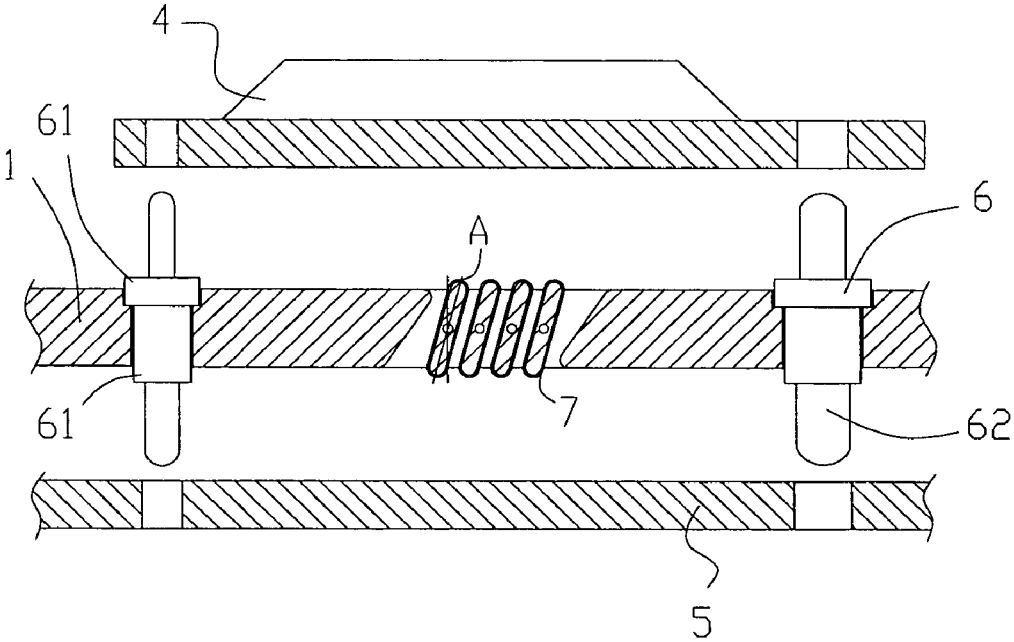
FIG. 6 is an assembling perspective view of an electrical connector and a mating electrical connector according to the present invention.

Reference is made to FIG. 6. The electrical connector further includes at least two positioning mechanisms 6. The supporting member 10 is formed with two contact areas via coating. The two contact areas define a straight line A that is slanted relative to the surface of the main portion 1. Each of the supporting members 10 is connected to the main portion 1 by a connecting portion 11, and the supporting members 10 can swing and rotate after being pressed. When the electrical connector contacts the mating electronic elements, it can achieve oscillated contact for pressing elastically and contacting the mating electronic elements via the connecting portion 11. After the connecting portion 11 is twisted, the supporting member 10 has a recovering force to recover its original position.

The main portion 1 and the supporting members 10 are formed integrally and the connecting portions 11 connect both respectively, which are made of elastic material with good flexibility. The supporting members 10 are applied with many metal layers 7, which can achieve electrical conduction. The first layer of the metal layers 7 is formed by utilizing a physical coating manner, such as sputtering coating, evaporation coating, or any other physical coating. The many metal layers are formed by electroplating except for the first layer.

The main portion 1 forms a positioning hole 12 at the four corners, respectively, for fixing the positioning mechanisms 6 on the main portion 1. The positioning mechanisms 6 can fix the mating electronic elements and the main portion 1. Each of the positioning mechanisms 6 includes a limiting portion 61 and a positioning post 62. The limiting portion 61 is used to limit the pressed height of the mating electronic elements. In an other embodiment, a limiting block can be disposed on the electrical connector. The positioning post 62 is used to position the electronic elements, which can prevent the mating electronic elements from being pressed excessively to destroy the electrical connector and can help position the electronic elements at a predetermined position. The limiting portion 61 and the positioning post 62 are formed integrally in this embodiment, but both can be separate, of course. When the electrical connector connects to the mating electronic elements, the positioning elements 6 can fix the corresponding mating electronic elements, respectively. The electrical connector can electrically connect with the two electronic elements by contacting compressively with the supporting members 10.

The electrical connector of the present invention has a simple structure and is easily manufactured to reduce production costs, which can enhance the effective contact of the electrical connector and the mating electronic elements.

While the invention has been described with reference to the preferred embodiments, the description is not intended to be construed in a limiting sense. It is therefore contemplated that the appended claims will cover any such modifications or embodiments as may fall within the scope of the invention defined by the following claims and their equivalents.

What is claimed is:

1. An electrical connector, comprising:

a main portion;

a plurality of displaceable twisting connecting portions connected with the main portion; and a plurality of supporting members, each being coupled orthogonally to at least one displaceable twisting connecting portion; and a plurality of metal layers respectively formed on the supporting members for achieving an electrical connection.

2. The electrical connector as in claim 1, wherein the supporting members are made of elastic material.

3. The electrical connector as in claim 1, wherein the main portion is made of elastic material.

4. The electrical connector as in claim 1, wherein a first layer of the metal layers is formed by physical coating manner.

5. The electrical connector as in claim 1, wherein the metal layers are formed by an electroplating manner except for a first layer thereof.

6. The electrical connector as in claim 5, wherein an outermost layer of the metal layers has high electric conductivity.

7. The electrical connector as in claim 5, wherein the metal layers has one layer made of copper.

8. The electrical connector as in claim 5, wherein the metal layers has one layer made of nickel.

9. The electrical connector as in claim 1, wherein the supporting members are able to oscillate relative to the main portion.

10. The electrical connector as in claim 1, wherein the supporting members are formed with two contact areas by coating the metal layers, and the two contact areas define a straight line that is slanted relative to the surface of the main portion.

* * * * *